US006863265B2

(12) United States Patent
Perry et al.

(10) Patent No.: US 6,863,265 B2
(45) Date of Patent: Mar. 8, 2005

(54) TAMPER RESISTANT FENCE

(75) Inventors: Haim Perry, Emerson, NJ (US); Bruce Cochrane, Sandton Johannesburg (ZA)

(73) Assignee: Safeguards Technology, Inc., Hackensack, NJ (US)

( * ) Notice: Subject to any disclaimer, the term of this patent is extended or adjusted under 35 U.S.C. 154(b) by 0 days.

(21) Appl. No.: 10/455,275

(22) Filed: Jun. 4, 2003

(65) Prior Publication Data

US 2004/0245515 A1 Dec. 9, 2004

(51) Int. Cl.[7] ..... E04H 17/14; E04H 17/00

(52) U.S. Cl. ..... 256/65.07; 256/21; 256/22; 256/65.02; 256/65.03; 256/69

(58) Field of Search ..... 256/21, 22, 65.02, 256/65.03, 65.07, 69

(56) References Cited

U.S. PATENT DOCUMENTS

| | | | | | |
|---|---|---|---|---|---|
| 118,156 | A | * | 8/1871 | Rohrer | 256/22 |
| 476,120 | A | * | 5/1892 | Baker | 256/22 |
| 712,259 | A | * | 10/1902 | Carr | 256/24 |
| 2,558,142 | A | * | 6/1951 | Lapp et al. | 256/21 |
| 2,754,092 | A | * | 7/1956 | Cremens | 256/21 |
| 2,840,349 | A | * | 6/1958 | Raymond | 256/21 |
| 2,870,996 | A | * | 1/1959 | Helt | 256/22 |
| 3,005,623 | A | * | 10/1961 | Kusel et al. | 256/65.03 |
| 3,033,532 | A | * | 5/1962 | McFall | 256/21 |
| 3,067,985 | A | * | 12/1962 | Cusack | 256/22 |
| 3,258,251 | A | * | 6/1966 | Culter | 256/22 |
| 4,174,096 | A | * | 11/1979 | Campbell | 256/65.02 |
| 4,919,394 | A | * | 4/1990 | Otte et al. | 256/65.06 |
| 6,029,954 | A | * | 2/2000 | Murdaca | 256/65.08 |
| 6,752,385 | B2 | * | 6/2004 | Zen et al. | 256/65.01 |
| 2002/0175321 | A1 | * | 11/2002 | Larsen et al. | |

FOREIGN PATENT DOCUMENTS

| | | | | |
|---|---|---|---|---|
| JP | 02308079 | A | * 12/1990 | E04H/17/14 |

* cited by examiner

*Primary Examiner*—Daniel P. Stodola
*Assistant Examiner*—Ernesto Garcia
(74) *Attorney, Agent, or Firm*—Skadden, Arps, Slate, Meagher & Flom LLP

(57) ABSTRACT

A security cover is used in conjunction with a visually pleasing picket fence barrier. The security cover, having a C-shaped cross section, restricts access to bolts used to couple each picket to top and bottom support beams and thereby prevents tampering with the fence.

4 Claims, 5 Drawing Sheets

TAMPER RESISTANT FENCE

FIELD OF THE INVENTION

The present invention relates to a method and system for providing a tamper proof modular fence and more specifically to a device for preventing the dismantling of the modular fence.

BACKGROUND

Physical barriers in the form of fences are used to surround various facilities ranging from private homes to government installations. The fence barrier employed in a particular facility are generally selected in accordance with relevant aesthetic and security considerations. For example, a low cost chain link fence is generally used in low security facilities, which do not require a visually pleasing surrounding fence. Other facilities require a more aesthetically pleasing fence. One such fence is a modular fence, including steel pickets, constructed in a configuration similar to a typical wooden picket fence.

In a typical configuration, upper and lower support beams are coupled to each of the vertical pickets in the fence section. Each support beam includes a plurality of bores adapted to match the coupling bores in the pickets. An upper support beam is coupled to a top coupling bore in each picket. A lower support beam is coupled to a lower coupling bore in each picket. In the typical implementation, a bolt is fitted through each picket bore and corresponding support beam bore. Hence, the plurality of vertical pickets is secured to the support beams by bolts fitted through corresponding bores in both. Moreover, the pickets are usually fitted onto the fence section at the field, i.e., after the supporting posts have been installed at the facility to be surrounded. This provides valuable flexibility in allowing for less than level positioning of the supporting posts, since the bolts allow the pickets to pivot and adjust to various angular orientations, thus remaining vertical despite an incline placement, for example. It may be appreciated that if the pickets are welded to the support beams, the adjustment for a skewed placement could not be made. However, the valuable flexibility provided by the use of field installable bolts detracts from the security function of the fence by allowing a potential intruder to dismantle the fence by removing the bolts. Accordingly, there is a need for a method and system for preventing a potential intruder from tampering with the fence while maintaining the flexibility provided by the use of field installable pickets.

SUMMARY OF THE INVENTION

In accordance with the present invention, a security cover is provided to restrict access to the bolts securing the pickets to the support beams. The security cover provides a physical enclosure that restricts access to each bolt head used to secure a support beam to the corresponding pickets and prevents the bolt from being removed so as to dismantle the pickets.

In one embodiment, the present invention provides a fence section that includes a first vertical support post and a second vertical support post, each including a bracket having a substantially vertical bore. The bracket extends substantially perpendicular from the support post in the direction of the other support post. The fence section includes a lower support beam and an upper support beam, each including a plurality of spaced horizontal bores directed in perpendicular to the plane defined by the first and second supporting posts. Each support beam also includes a pair of distal flanges having vertical bores adapted to mate with the vertical bores of a corresponding supporting post bracket. The fence section additionally includes a plurality of vertical pickets, each including an upper bore adapted to mate with a bore of the upper support beam and a lower bore adapted to mate with a bore of the lower support beam. A plurality of bolts are used to couple each vertical picket upper bore to a corresponding upper support beam bore and couple each vertical picket lower bore to a corresponding lower support beam bore.

The fence section also includes a cover having a C-shaped cross section. The cover has a plurality of vertical openings to allow each said vertical pickets to pass through the cover. The cover includes a pair of vertical surfaces extending substantially perpendicular to the vertical opening surface. The cover further has a first distal vertical bore at a first end of the cover and a second distal vertical bore at a second end of the cover. The first and second distal bores adapted to mate with corresponding vertical bores in the upper and lower support beams and with corresponding vertical bores in the supporting post brackets. The vertical surfaces of the cover are adapted to impede access to the bolts securing the pickets to the supporting beams when the cover is secured to the supporting post brackets and to the support beam by the distal bores. A plurality of security fasteners, each fitted within each of a cover distal bore, a supporting beam flange bore, and a supporting post bracket, are used to rigidly secure the bores in alignment therebetween and are adapted to prevent removal of each cover from the corresponding support beam.

BRIEF DESCRIPTION OF THE DRAWINGS

Embodiments of the invention will now be described, by way of example only, and with reference to the accompanying drawings, in which.

DETAILED DESCRIPTION

Figure 1:
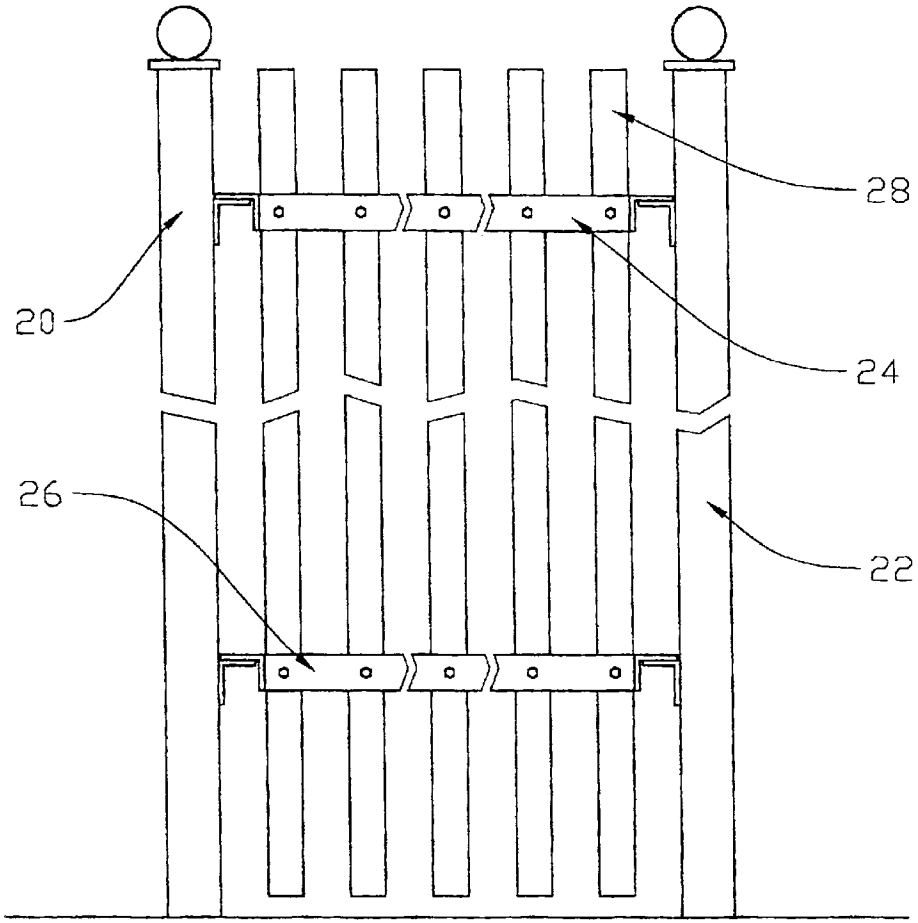
FIG. 1 illustrates a frontal view of a typical picket fence section.

FIG. 1 illustrates a typical modular steel picket fence structure. A first support post 20 and a second support post 22 are provided to define a section of the fence there between. Each such section includes a plurality of vertical steel pickets 28 secured to a pair of horizontal support beams 24 & 26. It may be appreciated that the fence structure may be composed of other materials such as . . .

Figure 2:
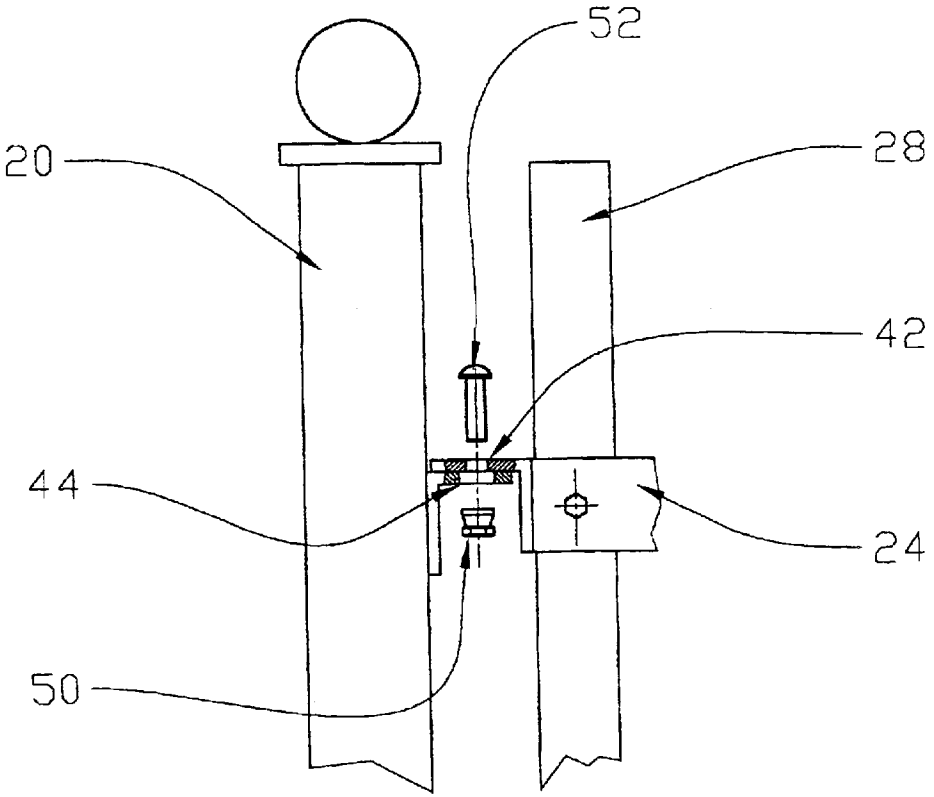
FIG. 2 illustrates a frontal view of the coupling structure for coupling a supporting post to a support beam in the fence section of FIG. 1.

FIG. 2 illustrates the coupling structure between the first support post 20 and the upper support beam 24. The upper support beam 24 is coupled to the first supporting post 20 by a flange 42 having a vertical bore. An L-shaped bracket 44 on the first supporting post 20 is provided with a corresponding vertical bore, adapted to align with the vertical bore of the beam flange 42. A bolt 52 and corresponding nut 50 are used to secure the beam flange 42 to the supporting post bracket 44, as is shown. An identical flange and bracket arrangement is provided on a second end of the support beam 24 and the second support post 22 so as to allow for securing the upper support beam between the first 20 and second support posts. The lower support beam 26 is coupled to the first and second support posts 20, 22 in a manner similar to that discussed with reference to the upper support beam 24 as may be appreciated.

Figure 3:
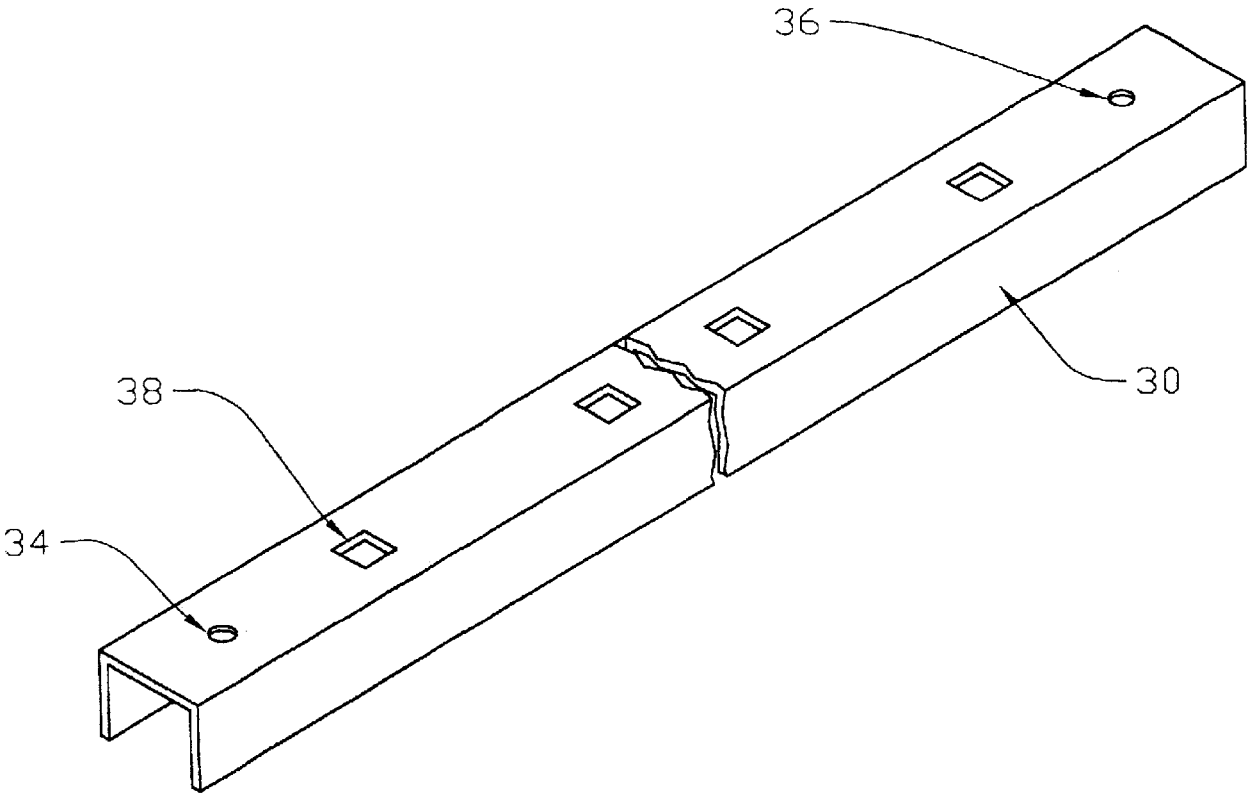
FIG. 3 illustrates a security cover of a fence section in accordance with the invention.

FIG. 3 illustrates a cover 30 adapted to enhance security in the fence section of FIG. 1. The cover 30 includes a pair of distal vertical bores 34 & 36 adapted to match the vertical bores in the brackets of the supporting posts 20, 22. A plurality of interior vertical picket openings 38 are provided, each adapted to allow for insertion of a single picket therethrough. The cover 30 includes a pair of vertical planer surfaces extending from the center surface, which includes the picket openings 38. The vertical surfaces are adapted to at least extend to cover the bolts used to secure the pickets to the supporting beams 24, 26.

Figure 4:
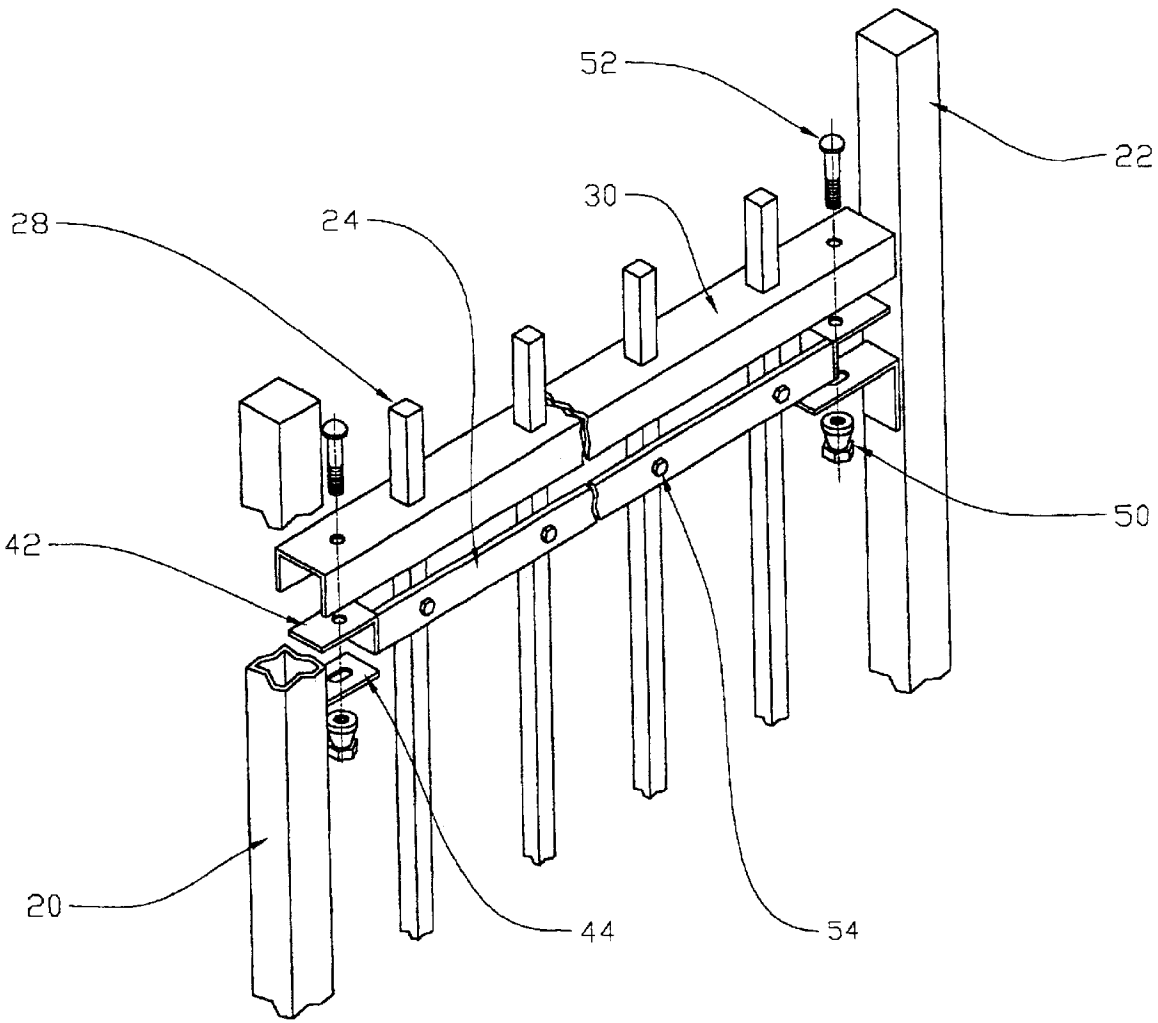
FIG. 4 illustrates an exploded view of a fence section including the security cover of FIG. 3 in accordance with the invention.

FIG. 4 is an exploded view of the security cover 30 of FIG. 3 and a corresponding upper support beam 24 in a fence section of the invention. As may be appreciated, the security cover is adapted for arrangement with the lower support beam 26 and corresponding support post brackets in the same manner as will be discussed below with reference to the upper support beam 24. As may further be appreciated, a first security cover is arranged with the lower support beam 26 prior to installation of a second security cover 30 with the upper support beam 24. As discussed above, each picket 28 is coupled to the upper support beam 24 by a pair of corresponding bores, one in each of the support beam and the picket. A bolt 54 is threaded through the bore to secure the picket top portion to the upper support beam 24. Each of the pickets 28 is also fitted through the corresponding opening in the security cover 30 to allow the security cover to rest on the upper support beam 24.

Figure 5:
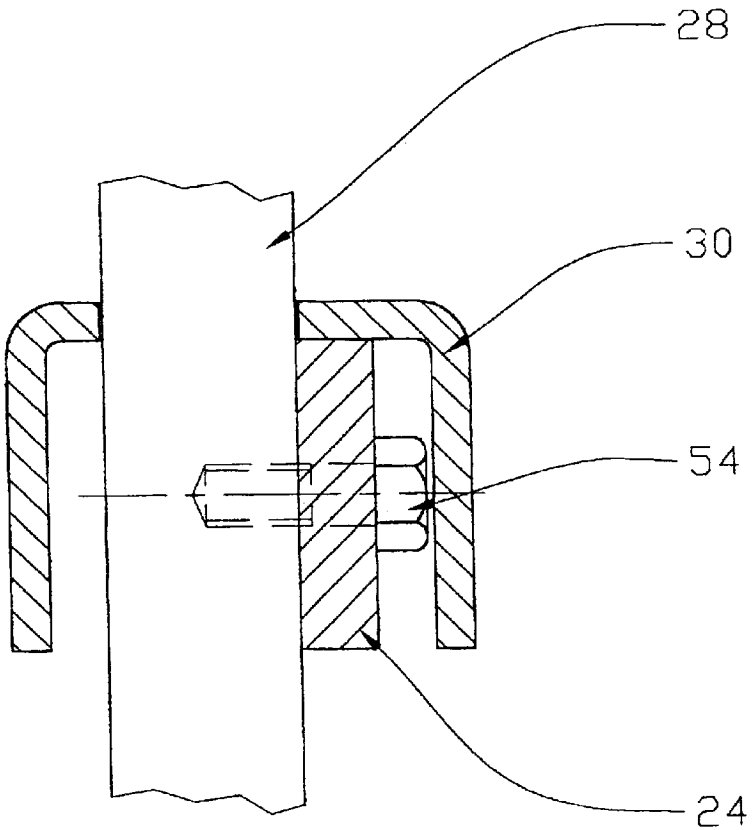
FIG. 5 illustrates a cross-section of a side view of the support beam and cover of the fence section of FIG. 4.

FIG. 5 illustrates a cross-section of a side view of the security cover 30 as fitted onto the upper support beam 24. As may be appreciated, the vertical surfaces of the security cover 30 extend to cover the bolts 54 coupling the pickets 28 to the upper support beam 24. Any attempt to draw the bolts 54 away from the pickets 28 will be resisted by impacting the vertical surfaces of the cover 30.

Referring back to FIG. 4, each distal bore 34 & 36 of the security cover 30 is adapted to match corresponding bores in a supporting post bracket 44 and the upper support beam flange 42. A single bolt 52 is fitted through the cover bore 34, the upper support beam bore 44, and the support post bracket bore 42. The bolt 52 is fitted with a special safety nut 50. The safety nut 50 includes an internally threaded smooth conical head that is coupled to a hexagonal gripping ring. The hexagonal ring is adapted to break off the conical head in response to application of torque beyond a threshold. This allows for securing the nut 50 to a corresponding bolt 52, followed by breaking off the gripping ring. Without the gripping ring, removal of the smooth conical nut from the bolt is extremely difficult. Identical safety nuts are employed on both sides of the upper support beam as well as both sides of the lower support beam.

Accordingly, by employing only four safety bolt and nut combinations per fence section, in conjunction with a pair of security covers, an entire set of picket coupling points to both upper and lower support beams is protected. This provides significant cost savings in both labor and materials as well as an increase in speed and ease of installation.

The foregoing merely illustrates the principles of the present invention. Those skilled in the art will be able to devise various modifications, which although not explicitly described or shown herein, embody the principles of the invention and are thus within its spirit and scope.

What is claimed is:

1. A fence section, comprising:

a first vertical support post and a second vertical support post, each of the first vertical support post and the second vertical support post including a bracket having a substantially vertical bore, the bracket extending substantially perpendicular from the support post in the direction of the other support post;

a lower support beam and an upper support beam each including a plurality of spaced horizontal bores directed perpendicular to the plane defined by the first and second supporting posts, each support beam further including a pair of distal flanges each having a vertical bore adapted to mate with the vertical bore of a corresponding supporting post bracket;

a plurality of vertical pickets, each including an upper bore adapted to mate with a bore of the upper support beam and a lower bore adapted to mate with a bore of the lower support beam;

a plurality of bolts coupling each vertical picket upper bore to a corresponding upper support beam horizontal bore and coupling each vertical picket lower bore to a corresponding lower support beam horizontal bore;

a cover having a C-shaped cross section, the cover including a plurality of vertical openings to allow each said vertical pickets to pass through the cover, the cover including a pair of vertical surfaces extending substantially perpendicular to said vertical openings, the cover further including a first distal vertical bore at a first end of the cover and a second distal vertical bore at a second end of the cover, the first and second distal bores adapted to mate with corresponding vertical bores in the upper and lower support beams and with corresponding vertical bores in the supporting post brackets, the vertical surfaces adapted to impede access to the bolts securing the pickets to the supporting beams when the cover is secured to the supporting post brackets and to a support beam by the distal bores; and a plurality of security fasteners each fitted within each cover distal vertical bore, the supporting beam flange bore, and the supporting post bracket, bore the security fasteners rigidly securing the cover distal vertical bore, the supporting beam flange bore, and the supporting post bracket bore in alignment therebetween and adapted to prevent removal of the cover from the support beam.

2. The fence section of claim 1, wherein said security fasteners each include a bolt and a safety nut.

3. The fence section of claim 1, wherein said vertical pickets are steel pickets.

4. The fence section of claim 2, wherein said safety nut includes a smooth exterior conical section having internal threading, the exterior section coupled to a gripping ring adapted to break from the exterior section in response to application of torque beyond a predetermined threshold.

* * * * *